US006430980B1

(12) United States Patent
Weinhold et al.

(10) Patent No.: US 6,430,980 B1
(45) Date of Patent: Aug. 13, 2002

(54) METHOD AND DEVICE FOR COATING AND SHAPING STRAND-SHAPED METALLIC MATERIAL BY DRAWING

(75) Inventors: Harri Weinhold, Kreischa; Armin Huebner, Dresden; Bernhard Kurze, Dresden; Gerd Zschorn, Dresden, all of (DE)

(73) Assignee: Ecoform Umformtechnik GmbH, Dresden (DE)

( * ) Notice: Subject to any disclaimer, the term of this patent is extended or adjusted under 35 U.S.C. 154(b) by 0 days.

(21) Appl. No.: 09/673,442

(22) PCT Filed: Apr. 15, 1999

(86) PCT No.: PCT/EP99/02750

§ 371 (c)(1),
(2), (4) Date: Nov. 30, 2000

(87) PCT Pub. No.: WO99/54066

PCT Pub. Date: Oct. 28, 1999

(30) Foreign Application Priority Data

Apr. 17, 1998 (DE) ..... 198 17 088

(51) Int. Cl.[7] ..... B21C 9/00
(52) U.S. Cl. ..... 72/43; 72/282
(58) Field of Search ..... 72/45, 44, 43, 72/282

(56) References Cited

U.S. PATENT DOCUMENTS 2,203,751 A * 6/1940 Simons
3,879,973 A * 4/1975 Godyn
4,553,416 A * 11/1985 Sudoh
4,739,640 A * 4/1988 Hurst
5,865,052 A * 2/1999 Weinhold
6,026,672 A * 2/2000 Miller

FOREIGN PATENT DOCUMENTS

GB 1176172 * 1/1970 ..... 72/43

* cited by examiner

*Primary Examiner*—Daniel C. Crane
(74) *Attorney, Agent, or Firm*—Reed Smith LLP

(57) ABSTRACT

Coating and shaping of strand-shaped metallic material by drawing using lubricants in solid to liquid state is disclosed. The disclosed method and arrangement enables high-performance shaping while decisively reducing expenditure on apparatus. At the same time, sealing problems with respect to lubricant are eliminated and several technical parameters in the shaping and coating process are improved depending on the material to be shaped. The shaping stock is coated with lubricant by a double chamber arrangement comprising a low-pressure lubricant chamber followed by a high-pressure lubricant chamber and is shaped by means of working drawing dies at the outputs of the chambers. The low-pressure chamber is filled with solid to pasty lubricant by a lubricant feed and a low pressure is applied to this lubricant externally. A high lubricant pressure is built up in the high-pressure lubricant chamber by the coated shaping stock running into this chamber, and a lubricant pressure/lubricant temperature combination is adjusted in such a way that the lubricant is in solid to liquid state. The disclosed method and arrangement is applicable in particular to wire drawing.

10 Claims, 1 Drawing Sheet

METHOD AND DEVICE FOR COATING AND SHAPING STRAND-SHAPED METALLIC MATERIAL BY DRAWING

This application is a 371 of PCT/EP99/02750, filed Apr. 15, 1999.

BACKGROUND OF THE INVENTION a.) Field of the Invention

The invention relates to the field of metallurgy and is directed to a method and a device for coating and shaping strand-shaped metallic material by drawing using lubricants in solid to liquid state.

b.) Description of the Related Art

In shaping metallic materials by drawing, solid, semi-solid and liquid lubricants are used, so that a lubricant layer is generated on the material to be shaped.

In a known method and a device for applying solid or semi-solid lubricants for cold-forming of metallic materials, the shaping stock is introduced into a closed chamber containing a lubricant which is liquefied under the influence of pressure and/or heat (DD 147 209). The chamber is constructed as a heatable pressure chamber and is connected with a charging and pressure-generating device for the lubricant. The pressure chamber has an inlet nozzle and an outlet nozzle through which the shaping stock to be coated passes.

This method and this device, which are suitable only for applying lubricant but not for simultaneous shaping in the outlet nozzle, have the disadvantage that the utilized lubricant has a low viscosity in its liquefied state. This limits the range of variation with respect to layer thickness and, because of the very thin lubricant layers that are achievable between the two elements in a frictional relationship, namely, the shaping tool and shaping stock, metallic shaping stock which is coated in this way passes through only one or only a few shaping stages with this coating. Moreover, the sealing of the inlet nozzle and the outlet nozzle is problematic, likewise because of the low viscosity of the lubricant.

Further, methods and devices are known in which a lubricant pressure is generated hydrostatically. In one of these devices, the wire passes through a pressure chamber containing a liquid lubricant before entering the drawing die. The lubricant pressure is generated by a pump. Another drawing die is used as a sealing nozzle at the inlet side of the pressure chamber for sealing (J. Schiermeyer, Dissertation TU Clausthal 1979; U.S. Pat. No. 3,413,832). Hydrodynamic lubrication conditions are to be generated in the main drawing nozzle by this construction of the device.

Difficulties are created in this prior art by sealing the pressure chamber by the sealing nozzle since additional lubrication must be carried out in case smaller dimensional changes are realized. It is also disadvantageous that the device must be provided with a wire that is already lubricated. Another disadvantage consists in that the shaping stock shaped by this device can generally not be used for further, subsequent shaping steps without re-coating with lubricant.

Another possibility for introducing the lubricant in the shaping zone of the drawing die under high pressure consists in arranging a run-in part of varying length in front of the drawing die; this can be a pipe, a profiled funnel or a drawing die (L. Gogecki, T. Prajsnar, Draht-Fachzeitschrift [Wire—Technical Periodical] 1972, 12, pp. 768–771; J. Schiermeyer, Dissertation TU Clausthal 1979). The inner diameter of the run-in part is slightly larger than the diameter of the wire running into it. Such devices are called hydrodynamic pressure nozzles. The elevated lubricant pressure is generated automatically by the moving wire transporting the lubricant (hydrodynamic pressure buildup). Very high lubricant pressures of approximately 300 MPa are generated in this way. This procedure has the disadvantage that the lubricant is pressed out of the tools in an uncontrolled manner due to the high pressures and the tools are frequently damaged or even destroyed.

Another known method and a device for shaping and/or coating strand-shaped shaping stock uses a pressure chamber having an inlet nozzle and an outlet nozzle for the shaping stock and a special feed for solid to pasty lubricant (WO 96/14946). For this purpose, a very high pressure in the range of several hundred MPa is applied to the lubricant in the pressure chamber externally by means of a special apparatus, wherein a combination of lubricant pressure and lubricant temperature is applied which avoids liquefaction of the solid to pasty lubricant in the pressure chamber. However, this process is disadvantageous in that the external generation of the high lubricant pressure involves a very high expenditure on apparatus and, on the other hand, in that lubricant frequently exits from the inlet nozzle in an uncontrolled manner in this device in the direction opposite to the drawing direction, especially during the transition of the lubricant to the pasty state. The escape of lubricant happens particularly when drawing wire rod which is often not round and/or when the device operates in the range of high lubricant pressures.

OBJECT AND SUMMARY OF THE INVENTION

It is primary the object of the invention to develop a method and a device for coating and shaping strand-shaped metallic material by drawing which enable high-performance shaping while appreciably reducing expenditure on apparatus, wherein sealing problems are eliminated at the same time and one or more technical parameters in the shaping and coating process are further improved depending on the material to be shaped.

This object is met according to the invention by a method for coating and shaping strand-shaped metallic shaping stock by drawing using lubricants in solid to liquid state in that the shaping stock is coated with lubricant by means of a double chamber arrangement comprising a low-pressure lubricant chamber followed by a high-pressure lubricant chamber and is shaped by means of working drawing dies at the outputs of the chambers. In so doing, the low-pressure lubricant chamber is filled with solid to pasty lubricant by an external lubricant feed and a low pressure is applied to the lubricant in the low-pressure lubricant chamber by means of this lubricant feed. A high lubricant pressure is generated in the high-pressure lubricant chamber by the shaping stock which runs into this chamber and which is coated with lubricant in solid to liquid state. The lubricant pressure/lubricant temperature combination in the high-pressure lubricant chamber is adjusted in such a way that the lubricant is in solid to liquid state in the latter.

According to the invention, the lubricant pressure in the high-pressure lubricant chamber is influenced by changing the shaping parameters and process parameters, especially by changing the lubricant pressure and the lubricant temperature in the low-pressure lubricant chamber, the drawing speed, the drawing die geometry and the degree of shaping.

According to an advisable development of the invention, the thickness of the lubricant film on the shaped material is measured and/or the lubricant pressure in at least one of the pressure chambers is measured. The measurements obtained are utilized for controlling or regulating the drawing speed, the lubricant pressure and/or the lubricant temperature.

The low-pressure lubricant chamber is advisably filled with lubricant continuously and via only one feed opening by means of an extruder and/or a gear pump. In so doing, the required lubricant pressure is also generated in the low-pressure lubricant chamber with these devices simultaneously in an advantageous manner.

According to the invention, a lubricant pressure of 80 MPa to at least 500 MPa is regulated in the high-pressure lubricant chamber. A lubricant pressure ranging from 0.2 MPa to a maximum of half of the value of the lubricant pressure to be adjusted in the high-pressure lubricant chamber is generated in the low-pressure lubricant chamber depending on the lubricant pressure desired for the high-pressure lubricant chamber.

The method can be applied in a single-step process as well as repeatedly in a multiple-step process. After an interruption in the shaping processes, it is advisable to carry out a brief reversal of the relative movement between the shaping stock and double chamber arrangement taking place during the shaping process and/or to reduce the pressure in the lubricant chambers.

The device according to the invention contains a double chamber arrangement comprising a low-pressure lubricant chamber for solid to pasty lubricant followed by a high-pressure lubricant chamber for solid to liquid lubricant by means of which the shaping stock is coated and shaped. The low-pressure lubricant chamber has an inlet nozzle for the shaping stock and, in the outlet, a working drawing die which simultaneously forms the inlet nozzle for the following high-pressure lubricant chamber. The high-pressure lubricant chamber is outfitted with another working drawing die at the outlet. Connected to the low-pressure lubricant chamber, there is a lubricant feed for supplying solid to pasty lubricant and for generating a lubricant pressure in the low-pressure lubricant chamber. Further, there are devices at the double chamber arrangement by means of which a lubricant pressure/lubricant temperature combination can be adjusted in the high-pressure lubricant chamber in such a way that the lubricant is in solid to liquid state in the high-pressure lubricant chamber.

According to the invention, a device for measuring the thickness of the lubricant film on the shaped stock can be arranged at the output of the device and/or a measurement sensor can be arranged at least at one of the pressure chambers for the lubricant pressure, wherein the measured value outputs are connected with devices for controlling or regulating the drawing speed, the lubricant pressure and/or the lubricant temperature.

According to an advisable construction of the invention, the low-pressure lubricant chamber is followed by an extruder and/or a gear pump for feeding the lubricant and for generating the lubricant pressure.

The double chamber arrangement can be outfitted with devices for cooling and/or heating to control and regulate the temperature ratios and pressure ratios.

The device according to the invention and the method according to the invention are distinguished by a number of advantages over the prior art.

A substantial advantage results from the surprising effect of a relatively large lubricant mass flow from the low-pressure chamber into the high-pressure chamber with simultaneous shaping by the working drawing die arranged between the chambers. The large lubricant mass flow is the basis for the buildup of the high lubricant pressure desired for the high-pressure chamber.

A substantial further development of the prior art also consists in the continuous lubricant feed realized by the invention, which is only made possible because of the double chamber principle of the low-pressure chamber and high-pressure chamber which can be applied in a surprising manner and which leads to considerable advantages compared with the known discontinuous lubricant supply (WO 96/14946). Accordingly, the lubricant feed according to the invention substantially simplifies the control and regulation of the entire coating process and of the installation, and expenditure for the required device system and for the operation of the installation is substantially reduced. For example, energy consumption is reduced by about 10%. The continuous lubricant feed also makes it easier to maintain constant lubricant pressures in the pressure chambers. This results in a more stable process control of the coating and shaping process and improves product quality. The more exact process control which is made possible results in favorable conditions for utilizing the entire range of technical effects of the device according to the invention even under strict requirements.

The introduction of the double chamber system according to the invention makes it possible to utilize the liquid state of lubricants which are solid, per se, in the high-pressure lubricant chamber because, due to the working drawing die in the inlet and outlet, this chamber no longer presents any sealing problems such as those occurring under certain circumstances in the prior art (WO 96/14946). The high-pressure lubricant chamber which is sealed by the working drawing dies also makes it possible to apply solid lubricant films which are thicker than those in the prior art (DD 147 209). Further, utilization of the liquid state of solid lubricants results in a higher-quality coating of the shaping stock by reason of the improved lubricant film adhesion and film forming in the liquid state. This is especially important when shaping high-alloy materials and in the case of special materials.

Further, the double chamber system according to the invention makes it possible to work in the low-pressure lubricant chamber with lubricant pressures that are sufficiently low that no significant sealing problems occur in this chamber either, even when the lubricant in the chamber is in the pasty state.

The invention will be described more fully in the following with reference to an embodiment example.

Figure 1:
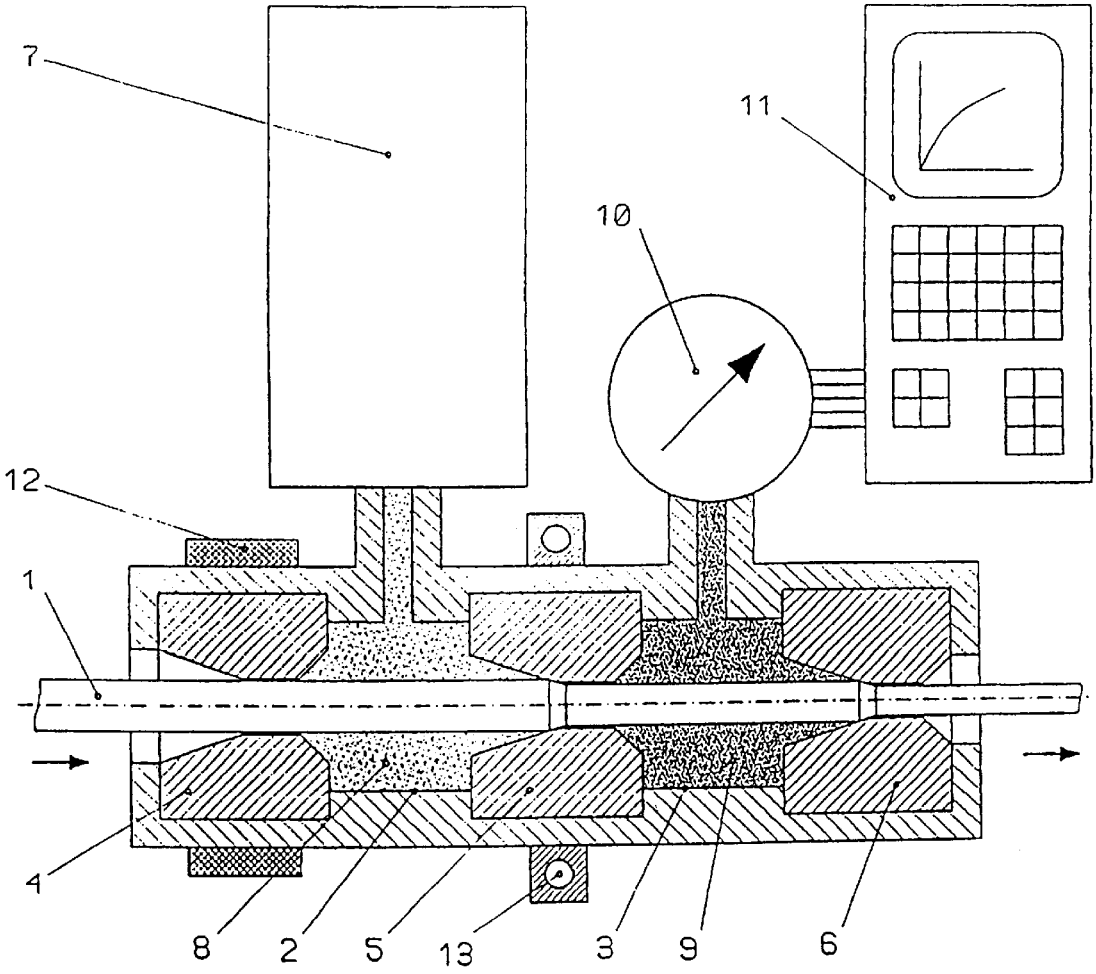
FIG. 1 illustrates a schematic view of a device for carrying out the method of the invention.

The device shown in the drawing is constructed with a double chamber arrangement by which the shaping stock 1 to be shaped is drawn through in the direction indicated by the arrows. The double chamber arrangement contains a low-pressure lubricant chamber 2 followed in the drawing direction by a high-pressure lubricant chamber 3.

At its inlet for the shaping stock 1, the low-pressure lubricant chamber 2 is outfitted with an inlet nozzle 4 whose nozzle diameter is 0.1 mm larger than the diameter of the entering shaping stock 1. A working drawing die 5 for shaping the shaping stock 1 exiting the low-pressure lubricant chamber 2 is arranged at the outlet of the low-pressure lubricant chamber 2 and simultaneously forms the input to the high-pressure lubricant chamber 3. Another working drawing die 6 is located at the outlet of the high-pressure lubricant chamber 3.

The low-pressure lubricant chamber 2 is connected with a lubricant feed 7 for supplying solid to pasty lubricant 8. The lubricant feed 7 comprises an extruder. A lubricant pressure in the range of approximately 40 MPa is generated in the chamber by this extruder. Solid lubricant based on calcium stearate can be used as lubricant 8, for example.

The high-pressure lubricant chamber 3 is designed to receive solid to liquid lubricant 9. A measurement sensor 10 is connected to the chamber and determines the lubricant pressure in the chamber. The measurement output of the measurement sensor 10 is connected with a device 11 for controlling or regulating the drawing speed, the lubricant pressure in the low-pressure lubricant chamber 2 and/or the lubricant temperature in the low-pressure lubricant chamber 2. A heating device 12 arranged at the low-pressure lubricant chamber 2 is used for influencing the lubricant temperature. Further, a cooling body 13 which can be used to cool the double chamber and which also enables temperature control is arranged in the area of the working drawing die 5 at the outer wall of the device.

No corresponding devices are provided at the high-pressure lubricant chamber 3 for filling this chamber with lubricant and for generating a high lubricant pressure. Rather, the amount of lubricant required in the high-pressure lubricant chamber 3 is automatically conveyed from the low-pressure lubricant chamber 2 into the high-pressure lubricant chamber 3 together with the entering shaping stock 1. At the same time, the desired high lubricant pressure on the order of 250 MPa is built up in this way in the high-pressure lubricant chamber 3.

A D43-quality steel wire, for example, can be coated and shaped by this device. The wire is shaped at a drawing speed of 2 m/ls in the device with a cross-sectional reduction of 10% by working drawing die 5 and with a cross-sectional reduction of 15% in working drawing die 6.

While the foregoing description and drawings represent the present invention, it will be obvious to those skilled in the art that various changes may be made therein without departing from the true spirit and scope of the present invention.

What is claimed is:

1. A method for coating and shaping strand-shaped metallic shaping stock by drawing using lubricants in solid to liquid state comprising the steps of:

coating shaping stock with lubricant by a double chamber arrangement comprising a low-pressure lubricant chamber followed by a high-pressure lubricant chamber; and shaping the stock by working drawing dies at the outputs of the chambers;

said method further including the steps of:

filling the low-pressure lubricant chamber with solid to pasty lubricant by an external lubricant feed and applying a low pressure to the lubricant in the low-pressure lubricant chamber by said lubricant feed;

generating a high lubricant pressure in the high-pressure lubricant chamber by the shaping stock which runs into said chamber and which is coated with lubricant in solid to liquid state;

wherein a lubricant pressure/lubricant temperature combination in the high-pressure lubricant chamber is adjusted in such a way that the lubricant is in solid to liquid state in the high-pressure lubricant chamber.

2. The method according to claim 1, wherein the lubricant pressure in the high-pressure lubricant chamber is influenced by changing the shaping parameters and process parameters, especially by changing the lubricant pressure and the lubricant temperature in the low-pressure lubricant chamber, the drawing speed, the drawing die geometry and the degree of shaping.

3. The method according to claim 1, wherein the thickness of the lubricant film on the shaped material is measured and/or the lubricant pressure in at least one of the pressure chambers is measured, and the measured values are utilized for controlling or regulating the drawing speed, the lubricant pressure and/or the lubricant temperature.

4. The method according to claim 1, wherein the low-pressure lubricant chamber is filled with lubricant continuously and via only one feed opening by means of an extruder and/or a gear pump, and the required lubricant pressure is generated.

5. The method according to claim 1, wherein a lubricant pressure of 80 MPa to at least 500 MPa is regulated in the high-pressure lubricant chamber.

6. The method according to claim 1, wherein a lubricant pressure ranging from 0.2 MPa to a maximum of half of the value of the lubricant pressure to be adjusted in the high-pressure chamber is generated in the low-pressure lubricant chamber depending on the lubricant pressure desired for the high-pressure lubricant chamber.

7. A device for coating and shaping strand-shaped metallic shaping stock by drawing using lubricants in solid to liquid state, comprising:

a double chamber arrangement formed of a low-pressure lubricant chamber for solid to pasty lubricant followed by a high-pressure lubricant chamber for solid to liquid lubricant by which the shaping stock is coated and shaped;

said low-pressure lubricant chamber having an inlet nozzle for the shaping stock and having, in the outlet, a working drawing die which simultaneously forms the inlet nozzle for the following high-pressure lubricant chamber;

said high-pressure lubricant chamber being outfitted with another working drawing die at the outlet;

a lubricant feed being connected to the low-pressure lubricant chamber for supplying solid to pasty lubricant and for generating a lubricant pressure in the low-pressure lubricant chamber; and devices being provided at the double chamber arrangement by which a lubricant pressure/lubricant temperature combination can be adjusted in the high-pressure lubricant chamber in such a way that the lubricant is in solid to liquid state in the high-pressure lubricant chamber.

8. The device according to claim 7, wherein a device for measuring the thickness of the lubricant film on the shaped stock can be arranged at the output of the double chamber arrangement and/or a measurement sensor for the lubricant pressure can be arranged at least at one of the pressure chambers, wherein the measured value outputs are connected with devices for controlling or regulating the drawing speed, the lubricant pressure and/or the lubricant temperature.

9. The device according to claim 7, wherein the low-pressure lubricant chamber is followed by an extruder and/or a gear pump for feeding the lubricant and for generating the lubricant pressure.

10. The device according to claim 7, wherein the double chamber arrangement is outfitted with devices for cooling or heating to control and regulate temperature ratios and pressure ratios.

* * * * *